US006289081B1

(12) United States Patent
Weekamp et al.

(10) Patent No.: US 6,289,081 B1
(45) Date of Patent: Sep. 11, 2001

(54) METHOD OF MANUFACTURING A FILTER, A FILTER THUS MANUFACTURED AND AN X-RAY EXAMINATION APPARATUS

(75) Inventors: Johannus Wilhelmus Weekamp; Jacobus Bernardus Giesbers; Bartholomeus Peter Hendricus Van Nunen; Adrainus Cornelius Van Kasteren; Menno Willem Jose Prins, all of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/680,191

(22) Filed: Oct. 5, 2000

(30) Foreign Application Priority Data

Oct. 5, 1999 (EP) ..... 99203249

(51) Int. Cl.[7] ..... G21K 3/00
(52) U.S. Cl. ..... 378/156; 378/158; 378/159
(58) Field of Search ..... 378/156, 158, 378/159

(56) References Cited

FOREIGN PATENT DOCUMENTS

WO 93
01048-A * 1/1993 (EP) .
WO 98
52468-A * 11/1996 (EP) .
WO 00
30125-A * 5/2000 (EP) .
WO 00
46814-A * 8/2000 (EP) .

* cited by examiner

*Primary Examiner*—Robert H. Kim
*Assistant Examiner*—Juric Yun
(74) *Attorney, Agent, or Firm*—John F. Vodopia

(57) ABSTRACT

The invention relates to a method of manufacturing a filter which includes a number of ducts formed by a number of deformable foils. The foils have electrically insulating outer sides, with electrically conductive bands which are separated from one another by electrically insulating bands. The electrically conductive bands on a first outer side of the foil are arranged so as to be offset relative to the electrically conductive bands on the second outer side of the foil. The foils are stacked. The oppositely situated electrically insulating bands of the oppositely situated foils are interconnected. The foils are ultimately moved away from one another in a direction transversely of the foils in order to form the ducts between the interconnected foils. At least one detached, electrically insulating section is situated in a prolongation of at least one electrically conductive band and is not connected to an oppositely situated foil.

9 Claims, 2 Drawing Sheets

METHOD OF MANUFACTURING A FILTER, A FILTER THUS MANUFACTURED AND AN X-RAY EXAMINATION APPARATUS

BACKGROUND OF THE INVENTION

The invention relates to a method of manufacturing a filter which is provided with a number of ducts, wherein:

a number of deformable foils is provided, on electrically insulating outer sides, with electrically conductive bands which are separated from one another by electrically insulating bands, the electrically conductive bands on a first outer side of the foil are arranged so as to be offset relative to the electrically conductive bands on the second outer side of the foil;

the foils are stacked;

oppositely situated electrically insulating bands of the oppositely situated foils are interconnected;

the foils are ultimately moved away from one another in a direction transversely of the foils in order to form the ducts between the interconnected foils.

SUMMARY OF THE INVENTION

The invention also relates to a filter manufactured by means of such a method and to an X-ray examination apparatus provided with such a filter.

In the context of the present patent application a filter is to be understood to mean any system of ducts comprising a number of ducts.

In such a filter of an X-ray examination apparatus as described in the not previously published European patent application 98203898.6, each of the electrically conductive bands is connected, near the upper side, to an electrically conductive strip which extends transversely of the electrically conductive bands. Adjacent the filter the electrically conductive strips are connected to electronic members for applying a desired potential to the relevant electrically conductive strips and the electrically conductive bands connected thereto. When a given potential is applied to an electrically conductive band, the associated duct is filled with a given, desired quantity of, for example, an X-ray absorbing liquid. In order to enable different potentials to be applied to the electrically conductive bands, each electrically conductive strip is connected to only one band or a few bands and is situated at a distance from the other electrically conductive strips and bands. The electrically conductive strips are separated from the other electrically conductive bands by electrically insulating sections.

A problem that has not yet been recognized in the cited European patent application is that when the foils are pressed against one another in order to realize a bond between the electrically insulating bands between the electrically conductive bands, for example, by means of thermocompression, a bond is also established between the electrically insulating sections of oppositely situated foils.

Consequently, the ducts to be formed between the foils are closed near such electrically insulating sections; this is undesirable.

It is an object of the invention to provide a method wherein the ducts are not closed.

The method according to the invention achieves this object in that in a prolongation of at least one electrically conductive band there is provided at least one detached, electrically insulating section which is not connected to an oppositely situated foil.

The closing of the ducts is prevented simply by preventing the electrically insulating sections which are situated in the prolongation of electrically conductive bands are bonded together.

In the context of the present patent application the term "detached" is to be understood to mean any electrically insulating section which is not mechanically connected to an oppositely situated foil in the finished filter.

A version of the method according to the invention is characterized in that the foils outside the detached, electrically insulating section are pressed against one another and bonded to one another by thermocompression.

The foils, being made of, for example a synthetic material, can be simply bonded to one another in the desired locations by thermocompression. The formation of a bond with the oppositely situated, detached, electrically insulating section of another foil can be prevented by locally controlling the pressure and/or temperature near the detached, electrically insulated section.

A further version of the method according to the invention is characterized in that the thickness of the foil is reduced at the area of the detached, electrically insulating section.

As a result of the reduction of the thickness of the detached sections, hardly any force will be exerted on the detached section when the foils are pressed against one another, so that the detached sections will not be interconnected.

A further version of the method according to the invention is characterized in that the foils are pressed against one another by means of a die which is provided with at least one recess which corresponds to the detached section.

This again prevents the detached sections from being interconnected upon the pressing together of the foils.

BRIEF DESCRIPTION OF THE DRAWINGS

The invention will be described in detail hereinafter with reference to the drawing; therein.

Corresponding parts are denoted by corresponding reference numerals in the Figures.

DESCRIPTION OF THE PREFERRED EMBODIMENTS

Figure 1:
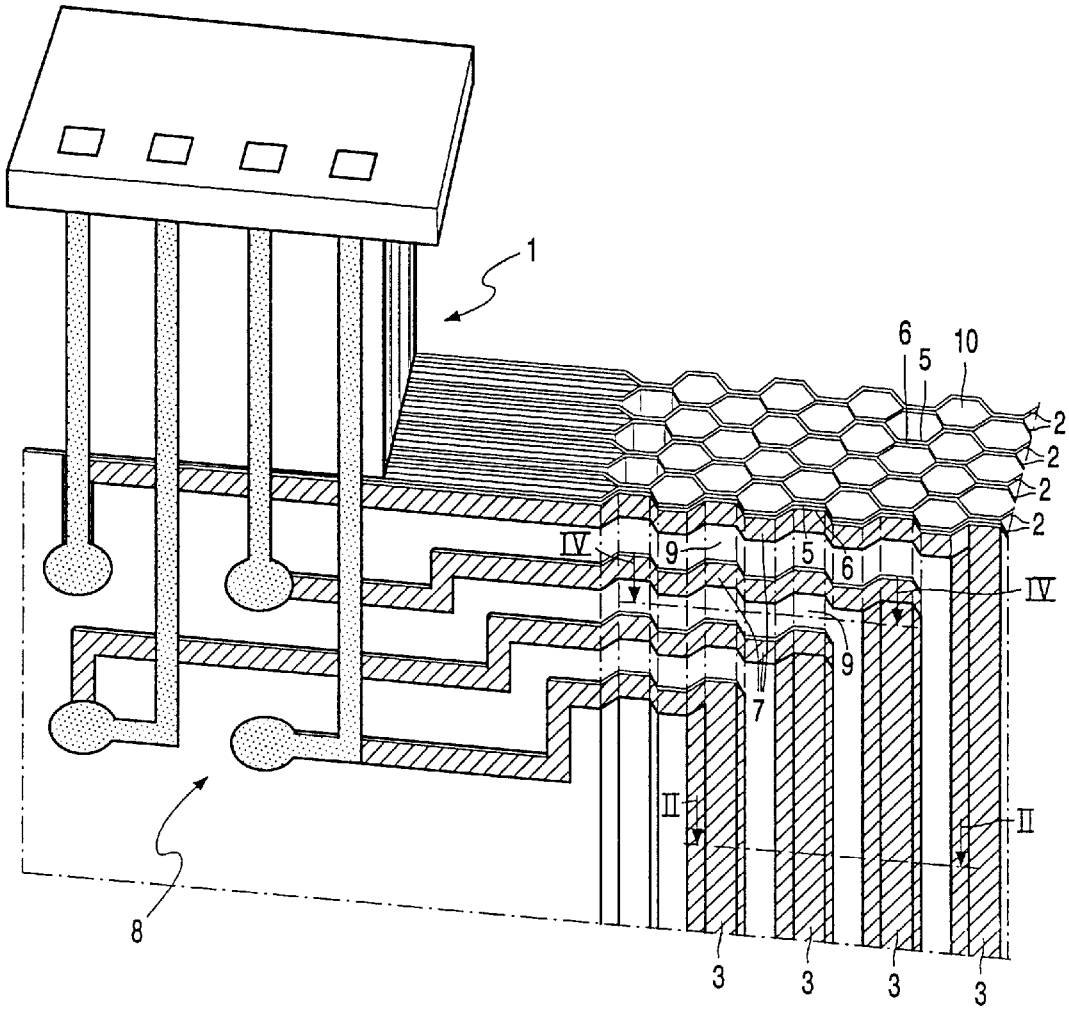
FIG. 1 is a perspective view of a filter according to the invention.
Figure 2:
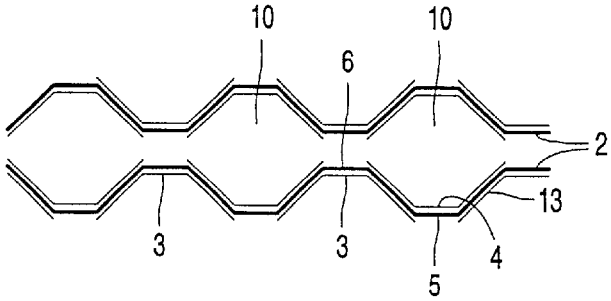
FIG. 2 is a cross-sectional view, taken in the direction denoted by the arrows II—II, of the filter shown in FIG. 1.
Figure 3:
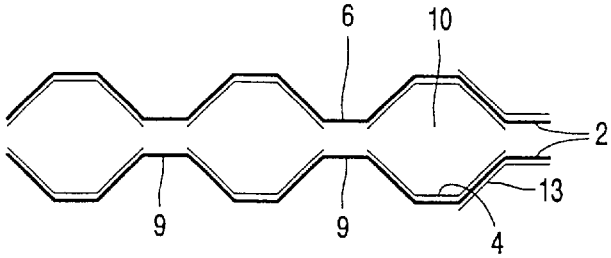
FIG. 3 is a cross-sectional view, taken at the area of the arrows IV—IV, of the filter shown in FIG. 1.

The FIGS. 1, 2 and 3 are a perspective view and cross-sectional views of a filter 1 according to the invention which is provided with a number of synthetic foils 2 of an electrically insulating material, each of which is provided on both sides with metal bands 3,4, for example aluminium bands, which extend in parallel. The metal bands 3, 4, as shown in the FIGS. 2 and 3, are arranged so as to be offset relative to one another. Between the metal bands 3, 4, the synthetic foil 2 is detached along elongate bands 5, 6. Near the top of the filter in FIG. 1 the metal bands 3, 4 are all connected to metal strips 7 which extend transversely of the metal bands 3, 4. The metal strips 7 extend to the left in the filter 1 shown in FIG. 1. On a side which is remote from the bands 3, 4 the strips 7 are connected to electrical members 8. In order to ensure that the bands 3, 4 which are adjacently situated on one side of the foil 2 are not electrically interconnected, the strips 7 are separated by strips of a synthetic material which extend transversely of the strips 5, 6. As a result of this arrangement, detached synthetic sections 9 are formed in the prolongation of each metal band 3, 4. As has already been described in the cited European patent application in the name of Applicant, the synthetic foils 2 are positioned opposite one another in such a manner that the detached synthetic bands 5 of one foil 2 are situated opposite the detached synthetic bands 6 of an oppositely situated foil 2. Subsequently, the synthetic foils are pressed against one another, with the result that the detached synthetic bands 5, 6 are bonded together by thermocompression.

During the pressing together of the synthetic foils 2 in order to bond together the synthetic bands 5, 6 of facing foils 2, it must be ensured that the detached synthetic sections 9 which are situated in the prolongation of the metal bands 3, 4 are not connected to a facing foil 2. This can be achieved by means of various methods.

Figure 4:
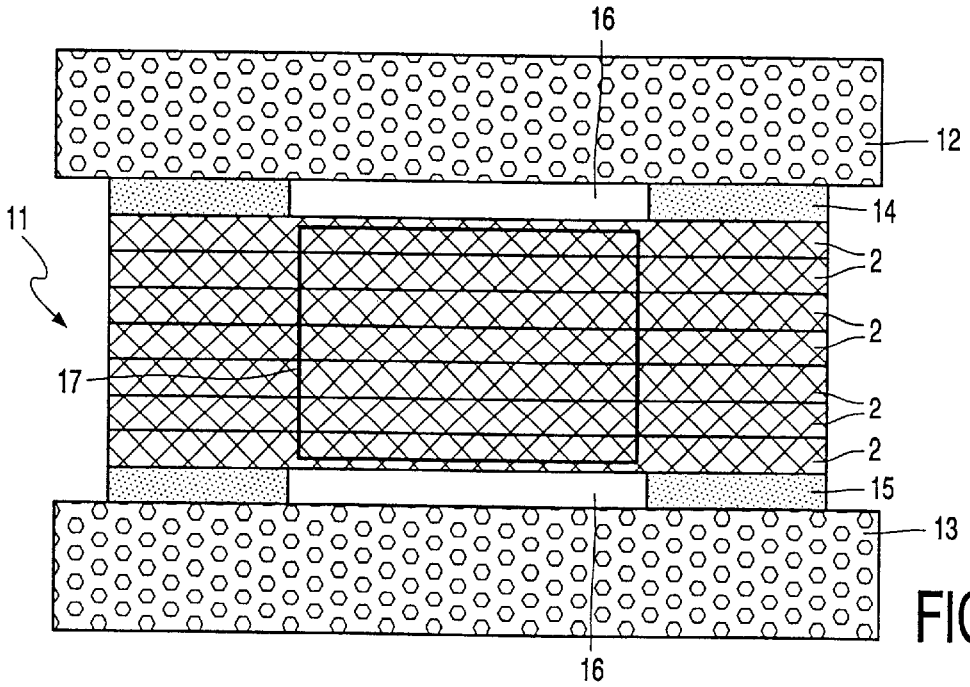
FIG. 4 is a cross-sectional view of a device during the pressing together of foils by means of a method according to the invention.
Figure 5:
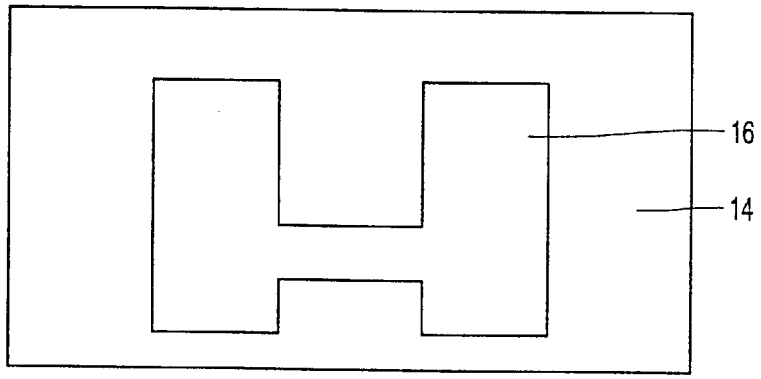
FIG. 5 shows a part of a die of the device shown in FIG. 4.

For example, FIG. 4 shows a device 11 for carrying out a first method according to the invention, which device includes two rigid plates 12, 13 which are displaceable in a direction towards and away from one another. The plates 12, 13 are provided with dies 14, 15 on facing sides. Each die 14, 15 is provided with a number of recesses 16 which correspond to the locations of the detached synthetic sections 9 of the foils 2. When the plates 12, 13 and the dies 14, 15 press together the foils 2 situated therebetween, no force will be exerted on the foils in the region denoted by the reference 17. Consequently, the sections 9 situated in the region 17 will not be pressed against one another and hence will not be bonded together.

Figure 6:
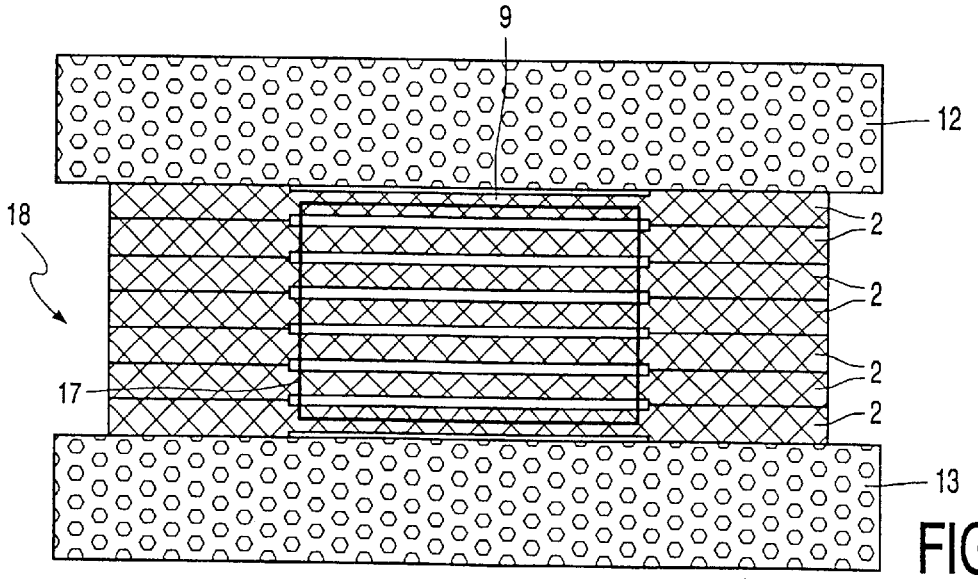
FIG. 6 illustrates a further version of a method according to the invention.

FIG. 6 shows a device 18 for carrying out a second version of the method according to the invention. The plates 12, 13 in the device 18 are not provided with stamps or dies 13, 14, 15 with recesses 16. In the device 18 shown in FIG. 6 the thickness of each of the foils situated therebetween is reduced near the sections 9 to both sides of the foils 2; the thickness is reduced by local removal of a part of the synthetic foil 2, for example by means of a laser. When the foils 2 are pressed against one another by means of the plates 12, 13, the local removal in the region 17 ensures that again no pressure is exerted on the sections 9 present therein, so that once more the sections 9 will not be bonded together.

The synthetic foil 2 may also be partly removed on one side only.

After the foils 2 have been bonded together, the interconnected foils 2 are pulled apart in a direction transversely of the surfaces of the foils 2, resulting in the honeycomb structure which is shown in FIG. 1 and comprises parallel ducts 10 without the sections 9 being connected to a facing foil.

It is alternatively possible for the metal strips to extend in a different direction relative to the metal bands instead of transversely thereof.

It is also possible for the metal bands and the synthetic bands situated therebetween to extend along curved lines instead of straight lines, with the result that the shape of the ducts 10 to be formed between the foils is also curved.

It is also possible to manufacture the foils while using different externally electrically insulating materials such as, for example, composite materials.

It is also possible to manufacture the electrically conductive bands and strips while using an electrically conductive synthetic material, composite, oxide or another inorganic material instead of metal.

The bands may also enclose an angle relative to one another.

The bands on different sides may also be situated at a different distance from one another.

It is alternatively possible to reduce the thickness of the foils on one side only.

It is also possible to reduce and not reduce the thickness of a foil in an alternating fashion.

The filter 1 according to the invention is inter alia suitable for use in an X-ray examination apparatus (not shown) in which the X-ray absorptivity of the individual ducts 10, constituting filter elements, is controlled by control of the quantity of X-ray absorbing liquid in the individual ducts. The quantity of X-ray absorbing liquid in a duct is adjusted on the basis of the electric voltage applied to the relevant duct by means of the electrical members.

What is claimed is:

1. A method of manufacturing a filter which is provided with a number of ducts, wherein:

a number of deformable foils is provided, on electrically insulating outer sides, with electrically conductive bands which are separated from one another by electrically insulating bands, the electrically conductive bands on a first outer side of the foil are arranged so as to be offset relative to the electrically conductive bands on the second outer side of the foil;

the foils are stacked;

oppositely situated electrically insulating bands of the oppositely situated foils are interconnected;

the foils are ultimately moved away from one another in a direction transversely of the foils in order to form the ducts between the interconnected foils, characterized in that in a prolongation of at least one electrically conductive band there is provided at least one detached, electrically insulating section which is not connected to an oppositely situated foil.

2. A method as claimed in claim 1, characterized in that at least one foil is also provided with at least one electrically conductive strip which extends at an angle relative to the electrically conductive band and one end of which is connected to an electrically conductive band, the detached, electrically insulating section being situated between the electrically conductive strip connected to the electrically conductive band and an adjacent electrically conductive band.

3. A method as claimed in claim 2, characterized in that the foils outside the detached, electrically insulating section are pressed against one another and bonded to one another by thermocompression.

4. A method as claimed in claim 1, characterized in that the thickness of the foil is reduced at the area of the detached, electrically insulating section.

5. A method as claimed in claim 4, characterized in that the thickness of the foil is reduced by local removal of a part of the foil.

6. A method as claimed in claim 1, characterized in that the foils are pressed against one another by means of a die which is provided with at least one recess which corresponds to the detached, electrically insulating section.

7. A filter manufactured by means of a method as claimed in claim 1, characterized in that the filter is provided with a number of interconnected foils, electrically conductive bands which extend in parallel on the foils, and at least one detached, electrically insulating section which is situated in the prolongation of at least one electrically conductive band and is not connected to an oppositely situated foil.

8. A filter as claimed in claimed in claim 7, characterized in that the thickness of the foil is reduced at the area of the detached, electrically insulating section.

9. An X-ray apparatus provided with a control device, an X-ray source, an X-ray detector and a filter as claimed in claim 7 which is situated between the X-ray source and the X-ray detector and is provided with ducts and an X-ray absorbing liquid which is contained in the ducts, the amount of X-ray absorbing liquid in individual ducts, and hence the X-ray absorptivity of the ducts, being adjustable by means of the control device.

* * * * *